United States Patent [19]

Moscovich

[11] Patent Number: 4,509,756

[45] Date of Patent: Apr. 9, 1985

[54] PUZZLE WITH ELEMENTS TRANSFERABLE BETWEEN CLOSED-LOOP PATHS

[76] Inventor: Ivan Moscovich, 19 Elkachi St., Afek-Ramat Aviv, Israel

[21] Appl. No.: 332,260

[22] Filed: Dec. 18, 1981

[51] Int. Cl.[3] ..... A63F 9/08
[52] U.S. Cl. ..... 273/153 S
[58] Field of Search ..... 273/153 S

[56] References Cited

U.S. PATENT DOCUMENTS

| | | | |
|---|---|---|---|
| 507,215 | 10/1893 | Churchill | 273/153 S |
| 1,085,050 | 1/1914 | Lathrop | 273/153 S |
| 1,257,205 | 2/1918 | Fallace | 273/153 S |
| 1,336,541 | 4/1920 | Shepherd | 273/153 S |

FOREIGN PATENT DOCUMENTS

| | | | |
|---|---|---|---|
| 2463632 | 4/1981 | France | 273/153 S |

*Primary Examiner*—Anton O. Oechsle
*Attorney, Agent, or Firm*—Benjamin J. Barish

[57] ABSTRACT

A game puzzle comprises a holder and a plurality of manipulatable elements movable within the holder along a plurality of closed-loop paths, which paths intersect each other at a plurality of intersection points. The manipulatable elements fill the closed-loop paths and are constrained by the holder to move only along one path except at the intersection points, whereat the elements may be transferred from one path to the other. In one described embodiment, the manipulatable elements are buttons movable along two closed-loop paths; in a second described embodiment, they are balls rollable along two closed-loop paths; and in a third described embodiment, the elements are movable along three closed-loop paths.

11 Claims, 8 Drawing Figures

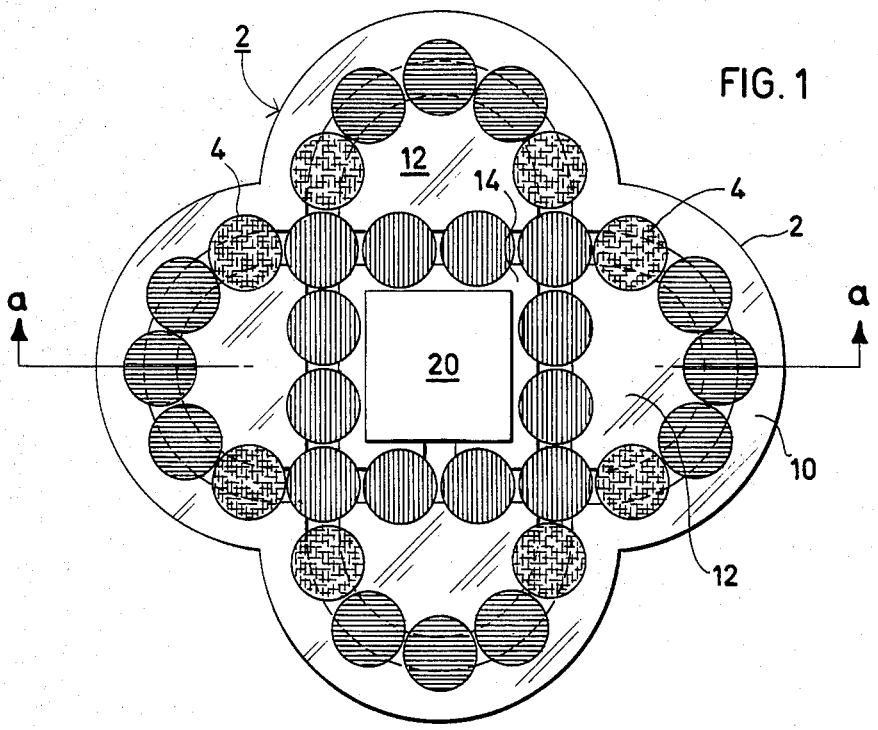
FIG. 1
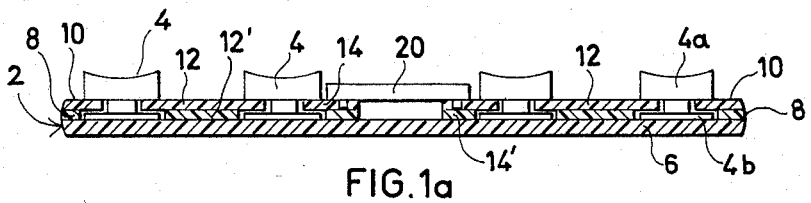
FIG. 1a
FIG. 1b
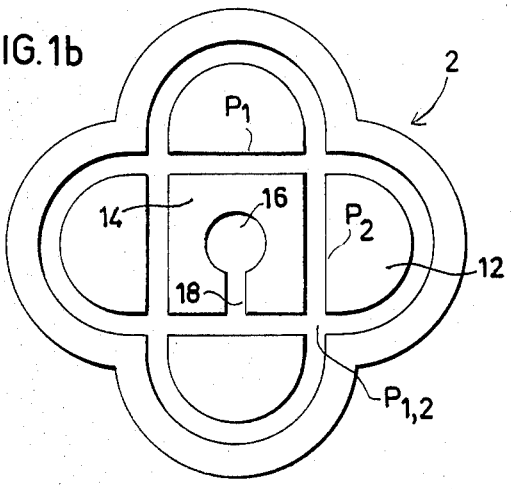
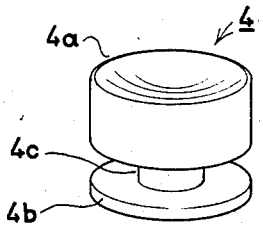
FIG. 1c

PUZZLE WITH ELEMENTS TRANSFERABLE BETWEEN CLOSED-LOOP PATHS

RELATED APPLICATIONS

The present application is related to my U.S. patent application No. 275,017, filed June 18, 1981, now Pat. No. 4,385,763, and also to U.S.A. Design application No. 237,893 filed Feb. 25, 1981 by me jointly with Frederick H. Kroll, abandoned.

BACKGROUND OF THE INVENTION

The present invention relates to games or puzzles, and particularly to game puzzles involving elements which may be manipulated in a holder to produce a predetermined pattern. Many such puzzles have been devised in which the elements may be manipulated only according to certain constraints, the object being to move the elements by the exercise of skill, ingenuity and experience, to reproduce a predetermined pattern.

An object of the present invention is to provide a new, entertaining and challenging game puzzle of this type.

BRIEF SUMMARY OF THE INVENTION

According to a broad aspect of the invention, there is provided a game puzzle comprising a holder and a plurality of manipulatable elements, including at least two distinguishable (eg. by color) kinds of elements, movable within the holder. The holder defines a plurality of at least two closed-loop paths of movement for the manipulatable elements, which closed-loop paths intersect each other at at least two points. The manipulatable elements fill the plurality of closed-loop paths and are constrained by the holder to move along one path except at the intersection points, whereat the elements may be moved along either of the closed-loop paths, thereby permitting the elements to be transferred at the intersection points from one closed-loop path to another.

In solving the puzzle, the elements are manipulated by the user's fingers along their respective closed-loop paths and are selectively transferred from one path to another at the intersection points, in order to produce the predetermined pattern, e.g., of colors, numbers, etc.

Several preferred embodiments of the invention are described below for the purposes of example.

In one described embodiment, the manipulatable elements are constituted of a plurality of buttons distinguishable according to three different colors, the buttons being movable along two closed-loop paths intersecting each other at four intersection points. In a second described embodiment, the manipulatable elements are differently colored balls also movable along two closed-loop paths intersecting each other at four intersection points. In a third described embodiment the manipulatable elements, e.g., buttons or balls, are movable along three closed-loop paths intersecting each other at six points of intersection.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a top plan view illustrating one form of game puzzle constructed in accordance with the present invention, FIG. 1*a* being a sectional view along lines a—a, FIG. 1*b* being a top plan of the holder illustrating the closed-loop paths, and FIG. 1*c* being a three dimensional view of one of the manipulatable elements;

DESCRIPTION OF PREFERRED EMBODIMENTS

Figure 2:
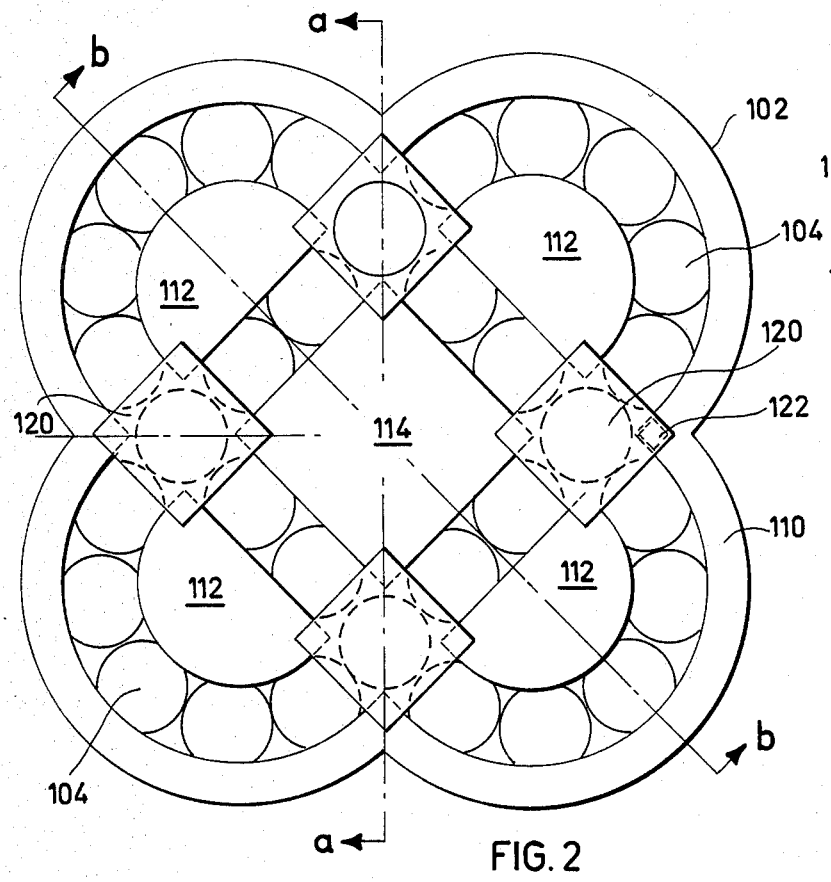
FIG. 2 is a top plan view of the second game puzzle constructed in accordance with the present invention, FIGS. 2*a* and 2*b* being sectional views along lines a—a and b—b respectively, of FIG. 2.
Figure 2A:
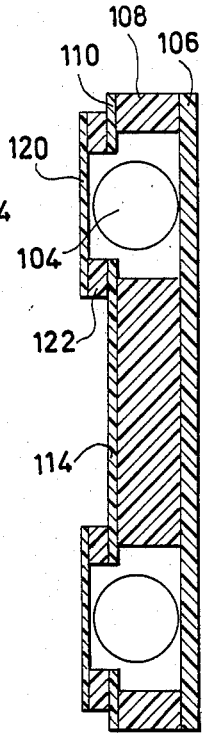
Figure 2B:
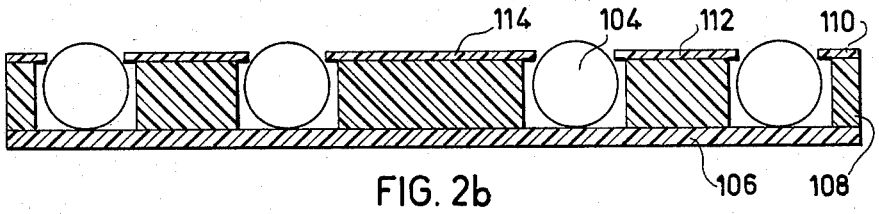

The game puzzle illustrated in FIG. 1 comprises a holder, generally designated 2, defining two closed-loop paths intersecting each other at four intersection points. The two closed-loop paths are best seen in FIG. 1*b*, wherein one closed-loop path is designated $P_1$, and the other is designated $P_2$, the four intersection points being designated $P_{1,2}$. It will be seen that each closed-loop path comprises a pair of straight sides joined by semi-circular ends, and that the two paths intersect such that their straight sides are essentially perpendicular to each other and their intersection points($P_{1,2}$) define the four corners of a square. The outer configuration of the two closed loop paths approximates a four-petal clover-leaf.

Movable within these two intersecting closed-loop paths $P_1$ and $P_2$ are a plurality of manipulatable elements in the form of buttons 4. All the buttons 4 are of the identical construction and appearance, as shown in FIG. 1*c*, except they are of three different colors. In the example illustrated in FIG. 1, each closed-loop includes eighteen buttons. Thus the total number of buttons in both closed-loops equals thirty-two, i.e., thirty six minus the four at the intersection points. Of these, twelve buttons are blue, eight are yellow, and twelve are red. The object pattern to be reproduced may be as shown in FIG. 1, wherein the twelve red buttons are to occupy a center square whose four corners constitute the intersection points $P_{1,2}$ of the two closed-loop paths $P_1$,$P_2$; the twelve blue buttons are to occupy the outer ends of the closed-loop paths; and the eight yellow buttons are to occupy the junctures between the blue and red buttons.

The construction of each button 4 is best shown in FIG. 1*c*, wherein it will be seen that it comprises a main body section 4*a* of cylindrical configuration, a base section 4*b* at the opposite end and of the same diameter as section 4*a*, and a reduced-diameter neck section 4*c* interconnecting sections 4*a* and 4*b*. Section 4*a* is the section viewable and manipulatable by the user, and its upper face is of concave configuration to facilitate manipulation by the user's finger. The base section 4*b* is received within the holder and constrains the manipulation of the button to the closed-loop paths of the holder, as will be described more particularly below.

The holder 4 comprises a flat bottom wall 6 circumscribed by a side wall 8 of the above-mentioned four-petal clover-leaf configuration. Side wall 8 terminates, at its upper face, in a ledge 10 flush with the outer face of side wall but projecting slightly inwardly of its inner face, as shown particularly in FIG. 1*a*. The inner faces of the four ledges 10 are of semi-circular shape.

Spaced inwardly from each of the four inner ledges 10 is a guide plate 12 having an outer semi-circular face and an inner straight face. The semi-circular outer faces of the guide plates 12 thus define, with the confronting semi-circular faces of the ledges 10, the four semi-circular ends of the two closed-loop paths $P_1$, $P_2$ of the holder 2. The inner straight faces of the guide plates 12 define, with a square guide plate 14 centrally of the holder, the four straight long sides of the two closed-loop paths $P_1$, $P_2$. The guide plates 12 and center plate 14 are joined to the bottom wall 6 of the holder by reduced-dimension junctures 12' and 14' for receiving the base sections **4*b* of the buttons 4**, such that the buttons can be manipulated along the closed-loop paths without separation lfrom the holder.

To facilitate the application of the buttons 4 to the holder 2, the center plate 14 is formed with an enlarged access opening 16 (FIG. **1*b*) of larger diameter than that of the buttons, and with a slot 18 leading from opening 16 to one edge of the plate. Thus, each button may be applied to the holder by passing its base section 4*b* through access opening 16 and moving it along slot 18 to the space between plate 14 and the contiguous guide plate 12, to enter the closed-loop path $P_1$. Opening 16 and slot 18 are closed by a square cap 20 (FIG. 1*a*) press-fitted into openings in the center plate 14** to overlie the upper face of the center plate.

The buttons (32 in the example illustrated in FIG. 1) are applied in the foregoing manner to the holder 2, to fill both of the closed-loop paths $P_1$ and $P_2$, whereupon the cap 20 is applied over the center plate 14 to cover the access opening 16 and slot 18. It will be seen that when the device is so assembled, the holder constrains the buttons to move only along one of the closed-loop paths $P_1$ or $P_2$ except at the four intersection points $P_{1,2}$, at which points the buttons may be moved along either closed-loop path. These intersection points thus permit buttons to be transferred from one closed-loop path to the other. However, when such a transfer is made, multiples of four buttons are transferred at the same time. Thus, skill, ingenuity and experience are required in order to plan the movements so as to produce any particular object pattern of button colors, e.g. the pattern illustrated in FIG. 1.

Preferably, the portions of the ledges 10, guide plates 12 and central plate 14 overlying the buttons 4 in the closed-loop paths are transparent.

FIG. 2, and its sectional views FIGS. **2*a* and 2*b*, illustrate a modification in the above described construction. The game puzzle of FIG. 2 is also of the same overall configuration as that of FIG. 1, namely, including two closed-loop paths intersecting each other at right angles to define a four-petal clover-leaf configuration. The manipulatable elements in the game puzzle of FIG. 2, however, are in the form of colored balls or beads, rather than buttons as in FIG. 1**.

More particularly, the holder 102 in the game puzzle of FIG. 2 is formed with a flat bottom wall 106 and a four-petal clover-leaf-configured side wall 108 having an inwardly-extended ledge 110, as in the FIG. 1 construction. In addition, it includes semi-circular guide plates 112 and a center plate 114, generally similar to the corresponding elements in the FIG. 1 construction, for defining the two closed-loop paths for the balls, these elements also being undercut so as to constrain the balls to be moved only along these paths.

The holder 102 is further provided with a bridging plate 120 at each of the four intersection points of the closed-loop paths. The bridging plates 120 are of square configuration and of a length longer than the diameter of the balls, so as to completely cover the ball at the respective intersection point of the two closed-loop paths. Each bridging plate 120 is spaced over the ball at the intersection point by four narrow posts 122 located at the four corners of the bridging plate.

Preferably, the four bridging plates 120, as well as the portions of the side wall 108, guide plates 112, and center plate 114 overlying the balls, are all transparent to permit the user to view the complete ball configuration while manipulating the balls.

It will be seen that the user may manipulate the balls by his fingers, and that the holder will constrain the movement of the balls only to their respective closed-loop path, except at the four intesection points, at which points the balls may be moved along either of the two closed-loop paths. Thus, the arrangement illustrated in FIG. 2 also permits, as in FIG. 1, balls to be transferred from one closed-loop path to the other, but at least four balls must be transferred at one time, thereby requiring the user to exercise ingenuity, skill and experience in order to plan the movements so as to produce the predetermined object color pattern of the balls.

The construction illustrated in FIG. 2 has the advantage that the guide plates 112, center plate 114, bridging plates 120, and spacing posts 122, may all be constructed as a single cover plate secured to overlie the bottom wall 106 of the holder, thereby substantially simplifying the construction of the device and permitting its manufacture at low cost and in volume as compared to the FIG. 1 construction.

Figure 3:
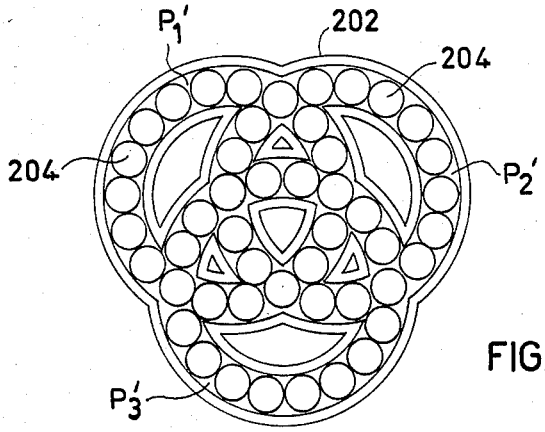
FIG. 3 is a top plan view schematically illustrating a third game puzzle constructed in accordance with the present invention.

FIG. 3 schematically illustrates a still further variation of the invention, wherein the holder, therein designated 202, is constructed so as to define three closed-loop paths, designated $P'_1$, $P'_2$ and $P'_3$, for the manipulatable elements 204. It will be seen that in this construction, there are six intersection points among the three closed-loop paths. The arrangement illustrated in FIG. 3 can thus be used for accommodating a larger number of manipulatable elements 204, either of the button construction of FIG. 1 or of the ball construction of FIG. 2, the six intersection points permitting the manipulatable elements to be transferred, in multiples of four, from one path to another in order to produce the predetermined object pattern of colors.

Instead of different colors, the manipulatable elements may have other distinguishing features, for example different indicia markings, letters, symbols, numbers, or outer configuration. Also, instead of three distinguishable kinds of elements, there may be two or four, or more. Further, the number of closed-loops could be greater than the two or three illustrated.

Many other variations, modifications and applications of the invention will be apparent.

What is claimed is:

1. A game puzzle, comprising:

a holder and a plurality of at least two distinguishable kinds of manipulatable elements movable within said holder;

said holder defining a plurality of at least two closed-loop paths of movement for said manipulatable elements, which closed-loop paths intersect each other at at least two points;

said manipulatable elements filling said plurality of closed-loop paths and being constrained by said holder to move only along one closed-loop path except at said intersection points whereat the elements may be moved along either of said closed-loop paths, thereby permitting an element to be transferred at said intersection points from one closed-loop path to another; said holder including a flat bottom wall, a plurality of guide members secured in spaced relationship to each other such as to define said plurality of closed-loop paths, and a plurality of bridging members overlying and bridging said guide members only at said intersection points to prevent separation of said manipulatable elements from the holder at said intersection points.

2. A game puzzle according to claim 1, wherein said holder defines two closed-loop paths, each path intersecting the other substantially perpendicularly at said intersection points.

3. A game puzzle according to claim 2, wherein each of said closed-loop paths is constituted of two straight parallel sides joined by semicircular ends, the straight sides of the two closed-loop paths intersecting substantially perpendicularly to each other at four intersection points defining the corners of a square.

4. A game puzzle according to claim 1, wherein said manipulatable elements are in the shape of buttons filling, and movable within, the plurality of closed-loop paths defined by said holder.

5. The game puzzle according to claim 4, wherein said holder includes a flat bottom wall and a plurality of guide members secured thereto in spaced relationship to said bottom wall and to each other so as to define said plurality of closed-loop paths; said manipulatable elements including sections receivable in the space, between said bottom wall and said guide members to constrain the movements of the manipulatable elements to said closed-loop paths.

6. The game puzzle according to claim 1, wherein said guide members and said bridging members are integrally formed as a single cover plate secured to overlie said bottom wall, said bridging members being transparent to permit viewing said manipulatable elements at said intersection points.

7. The game puzzle according to claim 1, wherein said holder defines three closed-loop paths intersecting each other at six intersection points.

8. A game puzzle, comprising:

a holder and a plurality of at least two distinguishable kinds of manipulatable elements movable within said holder;

said holder defining two closed-loop paths of movement for said manipulatable elements;

each of said closed-loop paths being constituted of two straight parallel sides joined by semicircular ends, the straight sides of the two closed-loop paths intersecting each other substantially perpendicularly to each other at four intersection points defining the corners of a square;

said manipulatable elements filling said two closed-loop paths and being constrained by said holder to move only along one closed-loop path except at said intersection points whereat the elements may be moved along either of said closed-loop paths, thereby permitting an element to be transferred at said intersection points from one closed-loop path to another.

9. A game puzzle according to claim 8, wherein said manipulatable elements are in the shape of buttons filling, and movable within, the two closed-loop paths defined by said holder.

10. A game puzzle according to claim 8, wherein said manipulatable elements are in the form of balls filling, and rollable within, the two closed-loop paths defined by said holder.

11. A game puzzle comprising: a holder and a plurality of at least two distinguishable kinds of manipulatable elements movable within said holder; said holder defining two closed-loop paths of movement for said manipulatable elements; each of said closed-loop paths being constituted of two essentially straight and essentially parallel sides joined by semicircular ends, the sides of the two closed-loop paths intersecting each other substantially perpendicularly to each other at four intersection points defining the corners of a square; said manipulatable elements filling said two closed-loop paths and being constrained by said holder to move only along one closed-loop path except at the intersection points whereat the elements may be moved along either of said closed-loop paths, thereby permitting an element to be transferred at said intersection points from one closed-loop path to another.

* * * * *